United States Patent [19]

Schoen

[11] Patent Number: 4,503,805

[45] Date of Patent: Mar. 12, 1985

[54] LIQUID DEVELOPER DEVICE

[75] Inventor: Klaus-Peter Schoen, Wiesbaden, Fed. Rep. of Germany

[73] Assignee: Hoechst Aktiengesellschaft, Frankfurt am Main, Fed. Rep. of Germany

[21] Appl. No.: 528,245

[22] Filed: Aug. 31, 1983

[30] Foreign Application Priority Data

Sep. 6, 1982 [DE] Fed. Rep. of Germany ..... 3233041

[51] Int. Cl.[3] ..... G03G 15/06

[52] U.S. Cl. ..... 118/649; 118/659

[58] Field of Search ..... 118/649, 659

[56] References Cited

U.S. PATENT DOCUMENTS 3,897,750 8/1975 Gunder ..... 118/637

*Primary Examiner*—Bernard D. Pianalto

*Attorney, Agent, or Firm*—Schwartz, Jeffery, Schwaab, Mack, Blumenthal & Koch

[57] ABSTRACT

Disclosed is a liquid developer device for a recording material which comprises at least one conveying device for applying a liquid developer to the recording material and a developer electrode attached to the conveying device in a manner such that the electrode floats on the developer layer at a constant distance from the recording material. In a further embodiment, the recording material, which has a latent electrostatic image on both its surfaces, is passed vertically between conveying devices. Also disclosed is a process for using both devices.

19 Claims, 5 Drawing Figures

LIQUID DEVELOPER DEVICE

BACKGROUND OF THE INVENTION

The present invention relates to a liquid developer device for a recording material, comprising at least one developer electrode which is connected with a conveying device for liquid developer for rendering visible the respective latent electrostatic image on the recording material.

A liquid developer device of this type is known from German Auslegeschrift No. 22 33 628. In this device, an arc-shaped developer electrode is arranged at a predetermined distance from the recording material which is in the form of a drum, so that a gap is formed. By a conveying device, the liquid developer is transported to the gap, in order to render visible the latent electrostatic image present on the drum-shaped recording material. The distance between the developer electrode and the drum-shaped recording material is adjusted by means of a distance regulating device which is equipped with slide members or rotatable rollers. The slide members or rotatable rollers, which are mounted at the ends of the developer electrode, maintain a defined distance between the recording material and the developer electrode. Additionally, springs are provided which force the distance regulating device into contact with the drum-shaped recording material. However, a relatively high constructional expense is required to ensure a uniform distance between the recording material and the developer electrode.

German Auslegeschrift No. 23 37 180 discloses a developer electrode for the cascade development of latent electrostatic images with a developer mixture. This electrode comprises a plurality of electrically conductive segments which are arranged along the width of the image area at equally spaced intervals, close to the image area to be developed. The segments are composed of angular metal sheets, the lateral edges of which are inserted into parallel slots provided in guide plates. Each of the sheet segments comprises a damming-up section and an electrode section which forms an obtuse angle with the damming-up section, the damming-up sections of two neighboring segments in each case forming a reservoir for the developer mixture delivered from above.

The developer electrode for powdery developer mixtures in accordance with German Offenlegungsschrift No. 2,164,494 (=U.S. Pat. No. 3,897,750) is pivotally mounted on a shaft and a spacing element is arranged at each side of the developer electrode.

A common feature to all these known developer electrodes, whether they are used for liquid or powdery developers, is that the mechanical expense necessary to maintain the gap between the developer electrode and the recording material carrying the latent electrostatic charge image to be developed is considerable.

SUMMARY OF THE INVENTION

It is therefore an object of the present invention to provide a liquid developer device having a developer electrode wherein the distance between the developer electrode and the recording material, which is required for developing, is built up without any additional means and is maintained automatically during the developing process.

It is also an object of the invention to provide an improved process for developing a recording material, using the apparatus of the invention.

In accomplishing the foregoing objects, there has been provided in accordance with one aspect of the present invention a liquid developer device for a recording material, comprising a frame, at least one conveying device arranged in said frame and having an outlet aperture for supplying a liquid developer to the side of a recording material carrying a latent electrostatic charge image in a predetermined layer thickness, and a developer electrode fastened to the conveying device near the outlet aperture, in such a way that the underside of the developer electrode contacts and floats on or rides on top of the liquid developer layer.

In another embodiment of the present invention the liquid developer device comprises a vertically positionable frame for carrying a recording material having a latent electrostatic charge image on both of its surfaces and two of the conveying devices positioned on either side along the vertical path of travel of the frame.

In accordance with another aspect of the present invention, there is provided a process for developing a recording material, comprising the steps of passing at least one conveying device, having an outlet aperture for supplying a liquid developer to the recording material with a developer electrode positioned near the outlet aperture, and the recording material in relation to one another to supply a layer of the liquid developer to the recording material and to develop the recording material, and floating the developer electrode on the liquid developer layer to ensure a uniform distance between the developer electrode and the recording material.

The advantage offered by the instant invention resides in the fact that, due to the flexibility of the developer electrode, the electrode floats on the layer of liquid developer, the thickness of which is solely determined by the pressure at which the liquid developer is forced through a gap of a given width and length. The uniform distance between the developer electrode and the recording material carrying the charge image to be developed is determined by the thickness of the layer of liquid developer, without the necessity of installing an expensive distance regulating device.

Further objects, features and advantages of the present invention will become apparent from the detailed description of preferred embodiments which follows, when considered with the attached drawings.

BRIEF DESCRIPTION OF THE DRAWINGS

The invention will now be explained in greater detail by reference to two exemplary embodiments shown in the attached drawings.

In the drawings.

DETAILED DESCRIPTION OF PREFERRED EMBODIMENTS

The developer electrode is arranged in a pivotally mounted frame of the liquid developer device and is fastened to the conveying device near the outlet aperture thereof. At a distance from the developer electrode, over the underside of which the liquid developer delivered through the outlet aperture flows in a layer thickness determined by the width of the aperture and the conveying pressure, the conveying device is moved along the recording material in a way such that the developer electrode floats on the layer of liquid developer.

In one embodiment of the invention, a suction plate on which the recording material rests is arranged in the frame, and the frame can be pivoted through an angle of about 10° C. to 90° C. relative to the horizontal.

The developer electrode is advantageously made of a plastic material and has a thickness of between 30 and 120 μm. Preferably, the developer electrode is a 75 μm thick polyester film provided with a conductive coating. The conductive layer is vapor-deposited aluminum.

Figure 1:
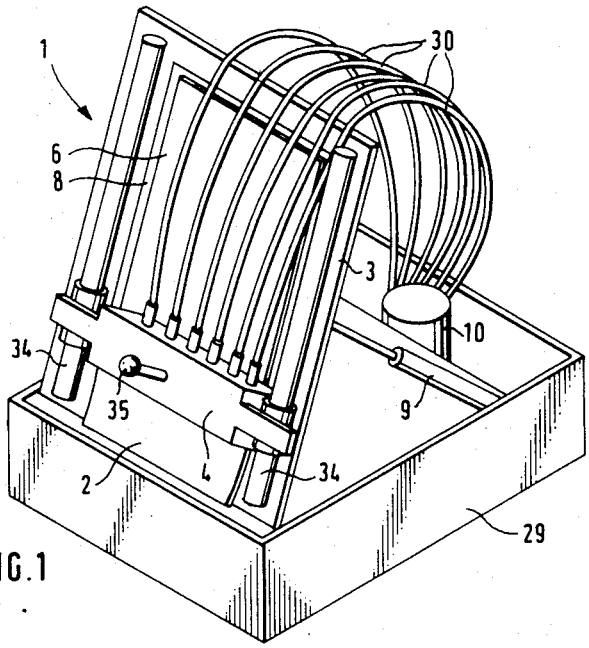
FIG. 1 is a perspective view of one embodiment of the invention for the single-sided development of a recording material.
Figure 2:
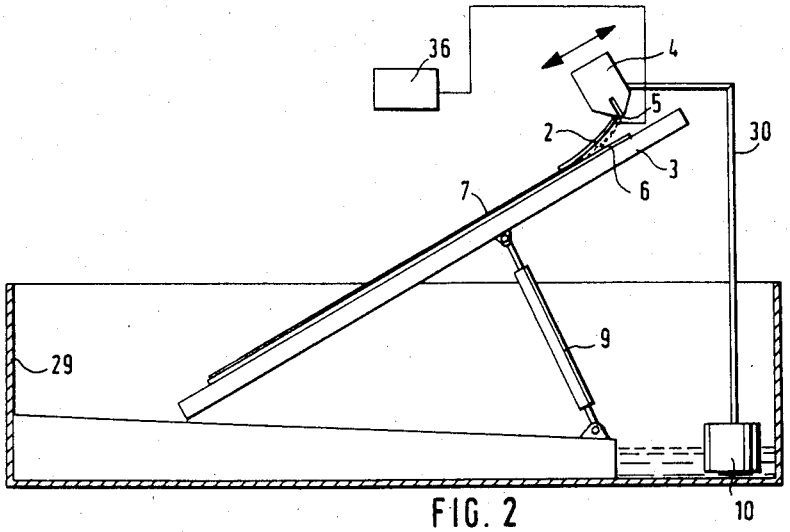
FIG. 2 is a diagrammatic sectional side view of FIG. 1.

The liquid developer device 1 of the present invention, which is shown in perspective view in FIG. 1 and in diagrammatic side view in FIG. 2, comprises a frame 3. Arranged in the frame 3 is a suction plate 8. A conveying device 4 which, for example, includes a slot die having an outlet aperture 5 in the form of a gap, is connected via lines 30 with a pump 10 installed in a trough 29 which contains a supply of liquid developer. The conveying device 4 extends over the width of a recording material 6 which on one side carries a latent electrostatic charge image which is developed with the liquid developer. The recording material 6 may, for example, be a printing plate or an electrophotographic circuit board, which rests on the suction plate 8 and is pressed against it by a vacuum applied to the suction plate 8. A cylinder 9 is fastened to the bottom of the trough 29. The piston of this cylinder 9 is joined with the underside of the frame 3. The frame 3 is pivotally attached to the trough 29, so that the inclination of the frame, and thus of the recording material, can be adjusted within a range of from about 10° C. to 90° C. in relation to the horizontal by extending the piston of the cylinder 9.

A developer electrode 2 is fastened to the conveying device 4 near the outlet aperture 5 of the conveying device. The conveying device 4 can be shifted along guide rails 34 which are arranged at a distance from and run parallel to the frame 3 in the longitudinal direction. For shifting, a handle 35 is provided in the middle of the conveying device 4.

The conveying device 4 is passed along the recording material at a distance from the recording material 6, in a way such that the developer electrode 2 floats on the layer 7 of liquid developer delivered through the outlet aperture 5, the thickness of the layer 7 being determined by the gap width and the discharge pressure. This ensures that a uniform distance corresponding to the thickness of the layer 7 of liquid developer is maintained between the developer electrode 2 and the charged and exposed surface of the recording material 6 during the development of the latent charge image. The voltage of the developer electrode 2 is usually maintained in the range from about 50 to 150 V. The voltage applied to the developer electrode 2 is supplied by a voltage source 36, which is connected to that surface of the developer electrode 2, which is provided with the conductive coating.

The developer electrode 2 is, for example, made of a plastic material having a thickness of between about 30 and 120 μm. In a preferred embodiment, the developer electrode 2 is a conductively coated polyester film having a thickness of about 75 μm. The conductive layer on the polyester film is comprised of vapor-deposited aluminum.

Figure 3:
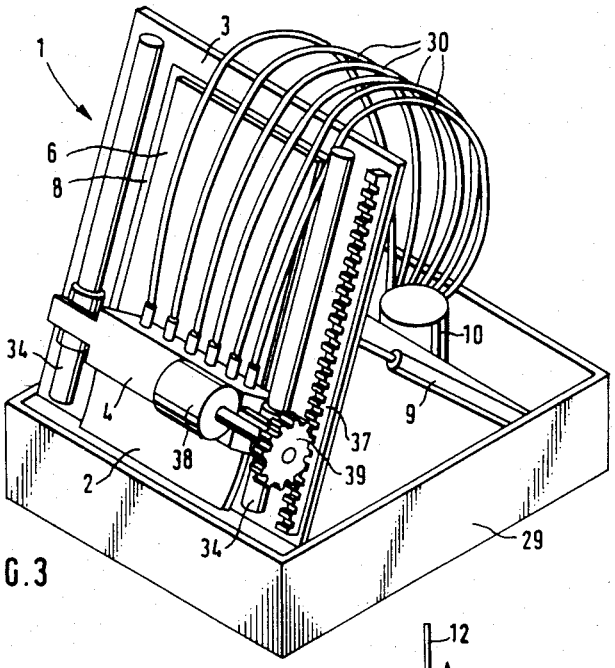
FIG. 3 illustrates a slightly modified embodiment of the present invention illustrated in FIG. 1.

The embodiment of the liquid developer device shown in FIG. 3 differs from the embodiment shown in FIG. 1 with regard to the conveying device 4. In comparison to the conveying device of FIG. 1 which is manually shifted along guide rails, the conveying device of FIG. 3 is moved over the recording material 6 by means of a toothed rack 37 which is driven by a motor 38 and mates with a toothed-wheel gearing 39 mounted on the conveying device 4. Needless to say, other, non-mentioned possibilities for positioning the conveying device along the recording material with the aid of a motor are available to persons skilled in the art.

Figure 5:
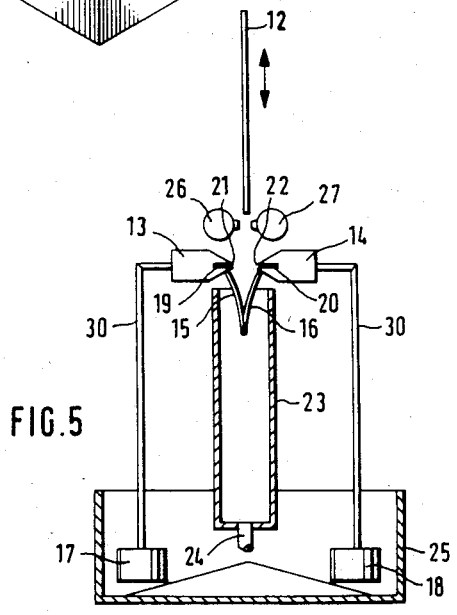
FIG. 5 is a diagrammatic sectional side view of FIG. 4.
Figure 4:
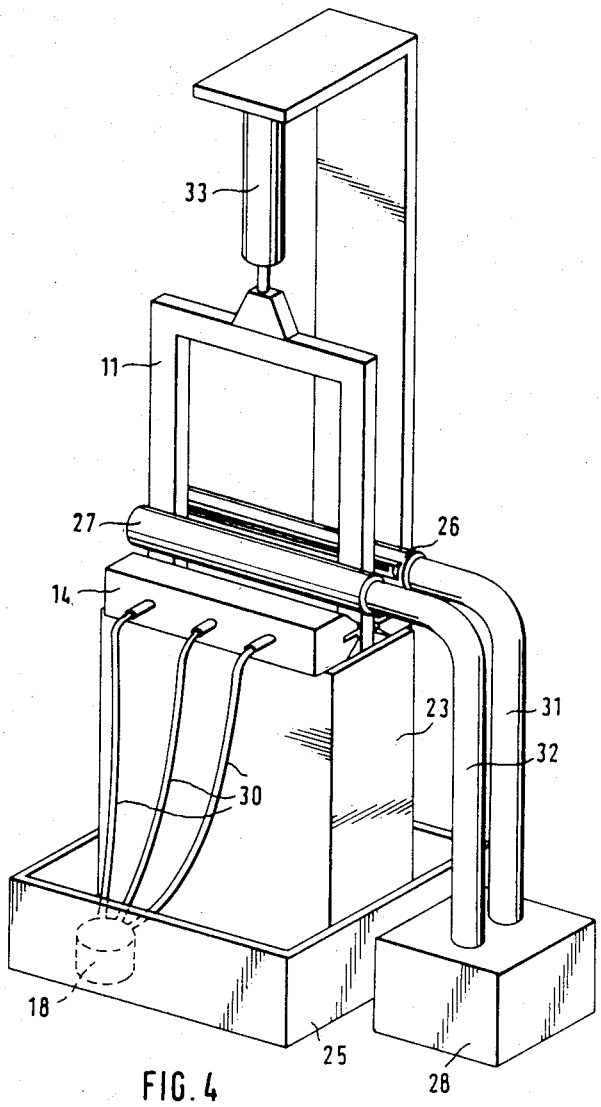
FIG. 4 is a perspective view of a second embodiment of the invention for the two-sided development of a recording material.

The embodiment of the liquid developer device 1 shown in FIGS. 4 and 5 provides for the simultaneous, double-sided development of a recording material 12 held by a clamping frame 11. This liquid developer device is symmetrically arranged about a vertical center line and comprises two conveying devices 13, 14 which are connected via pressure lines 30 with pumps 17, 18 located in a supply of liquid developer in a receiving trough 25. Each of the conveying devices 13, 14 has a slot die 19, 20. Developer electrodes 15, 16 are arranged below the outlet apertures 21, 22 of the slot dies 19, 20.

The clamping frame 11 is connected with the piston of a cylinder 33 above the clamping frame 11, by means of which the clamping frame 11 is shifted vertically and immersed into and removed from a bath 23. The bath 23 is designed as a trough which is open on its upper side, and provided with an outlet 24, through which excess liquid developer escapes into the receiving trough 25.

Air nozzles 26, 27, which are connected to a pressure source 28 via pressure lines 31, 32, are arranged above each slot die 19, 20.

The recording material 12, for example a printing plate exposed on both sides, is developed by fixing the recording material 12 in the clamping frame 11 and moving the latter downwardly by means of the cylinder 33. The latent electrostatic charge images present on the two sides of the recording material 12 are developed by the layer of liquid developer which is applied to the two surfaces of the recording material 12 through the outlet apertures 21, 22 of the slot dies. The developer electrodes 15, 16 float on the layer of liquid developer, in a way similar to that described above by reference to FIGS. 1 and 2. During the developing process, the distance between the developer electrodes and the surfaces of the recording material remains constant so that a uniform development of the latent charge images present on the surfaces of the recording material 12 is ensured. The slot dies 19, 20 are located above, but close to, the bath 23, and the predominant portions of the developer electrodes 15, 16 protrude into the interior of the bath 23. Immediately after passing the slot dies 19, 20, the recording material 12 is immersed into the bath 23. The dimensions of the bath 23 are such that all sizes of recording material to be processed can be completely immersed. Through the outlet aperture 24, the excess liquid developer flows from the surface of the recording material into the receiving trough 25. When the recording material is completely immersed into the bath 23, the reverse movement of the piston of the cylinder 33 is initiated, and the clamping frame 11 containing the recording material 12 moves upwardly. When the recording material 12 is passed between the air nozzles 26, 27, which are arranged opposite each other, excess developer liquid, which may still adhere to the surfaces of the recording material, is removed by the air streams blown through the air nozzles. In so doing, the recording material 12 can be removed from the clamping frame 11 in a semi-moist state and without the danger of being contaminated by still adhering, excess liquid developer. The recording material can be further processed, for example, by fixing and/or providing it with a finisher layer.

What is claimed is:

1. A liquid developer device for a recording material carrying a latent electrostatic charge image, comprising:

a planar frame having an adjustable inclination relative to the horizontal;

developing means for bringing a layer of liquid developer into contact with said recording material, such that said latent electrostatic charge image is developed, said developing means comprising at least one conveying device which is arranged in said frame and which has an outlet aperture of predetermined size for supplying said liquid developer under pressure to said recording material, such that said layer of liquid developer has a thickness which is determined by the size of said outlet aperture and said pressure, respectively; and a developer electrode which is fastened to said conveying device near said outlet aperture, in such a way that said developer electrode contacts and floats on said liquid developer layer.

2. A liquid developer device as defined in claim 1, further comprising a suction plate arranged in said frame, said suction plate supporting and positioning said recording material.

3. A liquid developer device as defined in claim 1, further comprising means for pivoting said frame relative to the horizontal.

4. A liquid developer device as defined in claim 3, wherein said frame is pivotable through an angle of between about 10° and 90° relative to the horizontal.

5. A liquid developer device as defined in claim 3, wherein said pivoting means comprises a cylinder for pivoting said frame.

6. A liquid developer device as defined in claim 1, wherein said developer electrode comprises a plastic material and has a thickness of between about 30 and 120 μm.

7. A liquid developer device as defined in claim 6, wherein said developer electrode comprises a polyester film.

8. A liquid developer device as defined in claim 6, wherein said developer electrode further comprises a conductive coating and has a thickness of about 75 μm.

9. A liquid developer device as defined in claim 8, wherein said conductive coating comprises vapor-deposited aluminum.

10. A liquid developer device as defined in claim 1, wherein said conveying device comprises a slot die.

11. A liquid developer device as defined in claim 1, further comprising a pump for supplying said liquid developer to said conveying device.

12. A liquid developer device as defined in claim 1, wherein said conveying device is movable along said frame.

13. A liquid developer device as defined in claim 1, wherein said developer electrode is maintained at a voltage of between about 50 and 150 V.

14. A liquid developer device for a recording material which comprises a first surface and a second surface, each of said surfaces carrying a latent electrostatic charge image, comprising:

clamping means for securing said recording material, said clamping means comprising a frame which is displaceable along a vertical path;

developing means for bringing a layer of liquid developer into contact with said recording material, such that each latent electrostatic charge image carried on said recording material is developed, said developing means comprising two conveying devices positioned symmetrically relative to each other along said vertical path, each of said conveying devices having an outlet aperture of predetermined size for supplying said liquid developer under pressure to said recording material such that said layer of liquid developer supplied by each outlet aperture of said conveying devices has a thickness which is determined by the size of said outlet aperture and said pressure, respectively; and two developer electrodes, each of which is separately fastened to one of said conveying devices near said outlet aperture, in such a way that each of said developer electrodes contacts and floats on one said liquid developer layer.

15. A liquid developer device as defined in claim 14, wherein each outlet aperture communicates with a separate slot die, each of said developer electrodes being attached separately to one said slot die below an outlet aperture.

16. A liquid developer device as defined in claim 15, further comprising a bath located below said slot dies for immersing said recording material during development.

17. A liquid developer device as defined in claim 16, wherein said bath includes an outlet aperture in the bottom of said bath.

18. A liquid developer device as defined in claim 16, further comprising a receiving trough positioned below said outlet aperture.

19. A liquid developer device as defined in claim 14, wherein said developer electrodes are positioned symmetrically relative to each other along said vertical path.

* * * * *